US007519532B2

(12) United States Patent
Rabha

(10) Patent No.: US 7,519,532 B2
(45) Date of Patent: Apr. 14, 2009

(54) TRANSCODING EVRC TO G.729AB

(75) Inventor: Pankaj K. Rabha, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 1044 days.

(21) Appl. No.: 10/953,978

(22) Filed: Sep. 29, 2004

(65) Prior Publication Data

US 2005/0075868 A1 Apr. 7, 2005

Related U.S. Application Data

(60) Provisional application No. 60/507,241, filed on Sep. 29, 2003.

(51) Int. Cl.
*G10L 19/04* (2006.01)

(52) U.S. Cl. ..... 704/219; 704/220; 704/221; 704/200; 704/203

(58) Field of Classification Search ..... 704/219, 704/220, 221, 200, 203
See application file for complete search history.

(56) References Cited

U.S. PATENT DOCUMENTS

| | | | | |
|---|---|---|---|---|
| 2003/0055629 | A1* | 3/2003 | Choi et al. | 704/201 |
| 2003/0177004 | A1* | 9/2003 | Jabri et al. | 704/219 |
| 2004/0002855 | A1* | 1/2004 | Jabri et al. | 704/219 |

* cited by examiner

*Primary Examiner*—Qi Han
(74) *Attorney, Agent, or Firm*—Ronald O. Neerings; Wade James Brady, III; Frederick J. Telecky, Jr.

(57) ABSTRACT

Transcoding from EVRC to G.729ab with LSP parameters interpolated from EVRC to G.729ab, EVRC pitch used as input to G.729ab closed-loop pitch search, and G.729ab fixed codebook pulses found from a search limited to positions of EVRC fixed codebook pulses together with positions of target-impulse correlation maxima on the subframe tracks or full track search if no EVRC pulses.

5 Claims, 4 Drawing Sheets

TRANSCODING EVRC TO G.729AB

CROSS-REFERENCE TO RELATED APPLICATIONS

The application claims priority from provisional application No. 60/507,241, filed Sep. 29, 2003.

BACKGROUND OF THE INVENTION

The present invention relates to signal processing, and more particularly to speech encoding and decoding apparatus and methods.

EVRC (enhanced variable rate coding) provides speech coding at bit rates of 8.55 kbps (Full-rate), 4.0 kbps (Half-rate), and 0.8 kbps (⅛ rate); EVRC is widely used for second generation CDMA cell phone systems. G.729ab (a low complexity version of G.729) provides speech coding at a bit rate of 8 kbps and is popular for VoIP (voice over Internet protocol). EVRC and G.729ab both use digital speech sampled at 8 KHz and both have an ACELP (algebraic code excited linear prediction) structure. That is, both first perform LP analysis on a (sub)frame to find LP coefficients and convert them to line spectral pairs (LSPs) for quantization; next, both perform a pitch extraction plus an adaptive codebook search, quantized the pitch and adaptive codebook gain; then both search an algebraic fixed codebook to find an interleaved multiple pulse excitation vector and fixed codebook gain; and lastly quantize the parameters. However, EVRC and G.729ab are not directly compatible. Indeed, EVRC has frames of 160 samples partitioned into three subframes of 53, 53, and 54 samples; whereas, G.729ab has frames of 80 samples partitioned into two subframes of 40 samples.

Traditional transcoding from EVRC to G.729ab simply decodes input EVRC, synthesizes the speech, and then encodes the reconstructed speech with G.729ab for output; but this requires large computing power. And there is a demand for a lower complexity transcoding.

Transcodings between GSM (global system for mobile communication) and G.729 and between EVRC and AMR (adaptive multi rate) with direct parameter transformation rather than decoding followed by encoding have been suggested. For example, Tsai et al, GSM to G.729 Speech Transcoder, Proc. IEEE ICECS 485 (2001) and Lee et al, A Novel Transcoding Algorithm for AMR and EVRC Speech Codecs via Direct Parameter Transformation, Proc. IEEE ICASSP II-177 (2003).

SUMMARY OF THE INVENTION

The present invention provides transcoding for ACELP speech encodings by direct use of some input parameters, such as LP coefficients and pitch delay, and simplified fixed codebook searches by use of input fixed codebook pulse positions to limit positions searched.

Preferred embodiment methods transcode from EVRC to G.729ab with low complexity.

DESCRIPTION OF THE PREFERRED EMBODIMENTS

1. Overview

Figure 1A:
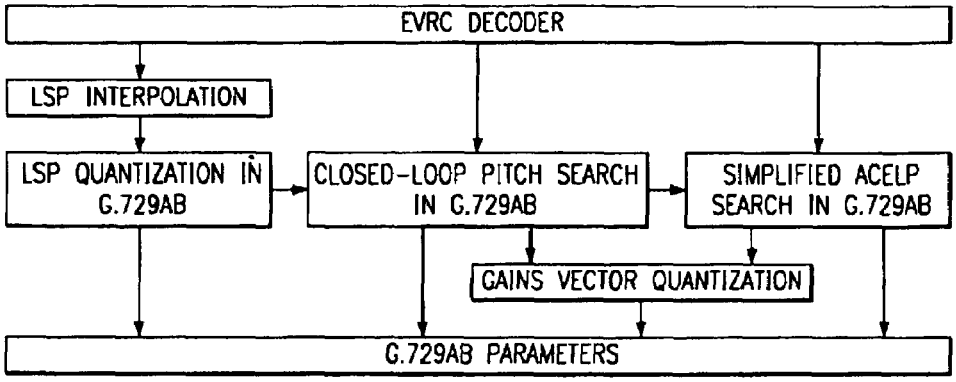
FIGS. 1*a*-1*b* are flow diagrams.
Figure 1B:
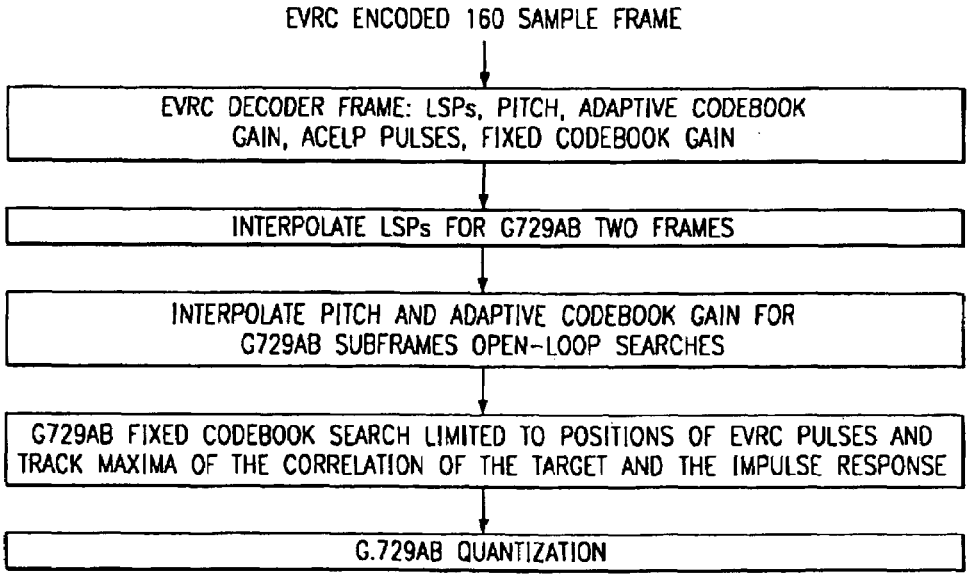

Preferred embodiment methods provide low-complexity transcoding from EVRC to G.729ab by (1) directly converting EVRC LSPs to G.729ab LSPs, (2) directly converting EVRC pitch delay to G.729ab open-loop pitch delay used in the adaptive codebook search, and (3) using EVRC fixed codebook vector pulse positions to limit the G.729ab pulse positions searched (with a EVRC-synthesized frame). See FIGS. 1*a*-1*b*. The preferred embodiment methods lower computational load while still applying an error minimization to ensure synthesized speech quality.

Preferred embodiment systems perform preferred embodiment methods with digital signal processors (DSPs) or general purpose programmable processors or application specific circuitry or systems on a chip (SoC) such as both a DSP and RISC processor on the same chip with the RISC processor controlling. Processing data would be stored in memory at both an encoder and decoder, and a stored program in an onboard ROM or external flash EEPROM for a DSP or programmable processor could perform the signal processing. Analog-to-digital converters and digital-to-analog converters provide coupling to the real world, and modulators and demodulators (plus antennas for air interfaces) provide coupling for transmission waveforms. The encoded speech can be packetized and transmitted over networks such as the Internet.

2. EVRC and G.729ab Parameters

Figure 3:
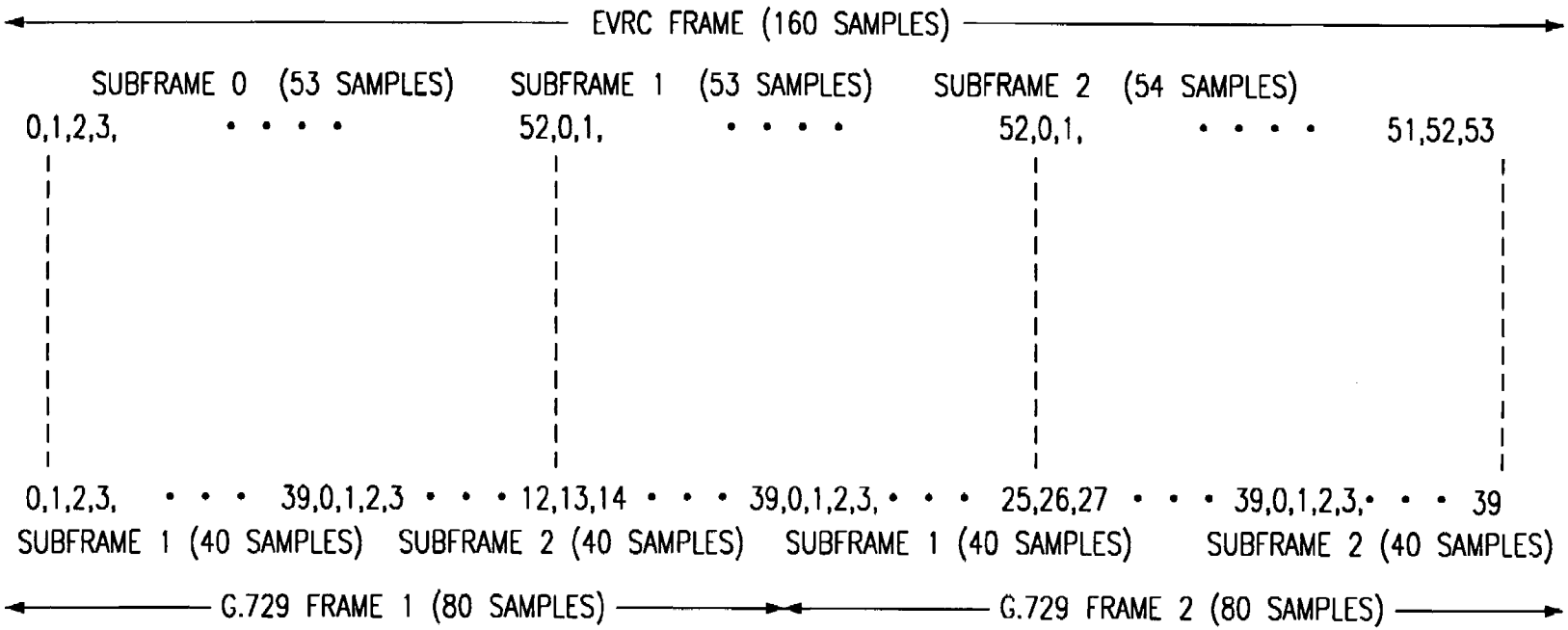
FIG. 3 illustrates frames and subframes for EVRC and G.729.

Prior to describing the preferred embodiment methods, consider the parameters available from an EVRC encoded stream and parameters required for an encoded G.729ab stream. First, as illustrated in FIG. 3, EVRC has 160-sample frames divided into three subframes of 53, 53, and 54 samples; whereas, G.729ab has 80-sample frames partitioned into two 40-sample subframes. The preferred embodiment methods generate G.729ab frames synchronized with input EVRC frames as illustrated in FIG. 3.

Both EVRC and G.729ab have ACELP structure and encode analogous parameters: LSPs, pitch delay, adaptive codebook gain, fixed codebook vector (pulse positions and signs), and fixed codebook gain. The table shows the allocation of bits per frame (160 samples for EVRC in three subframes and 80 samples in two subframes for G.729ab):

| parameter | EVRC full-rate | EVRC half-rate | G.729ab |
|---|---|---|---|
| LSPs | 28 | 22 | 18 |
| Pitch delay | 7 + 5 | 7 | 14 (8 + 5 + parity) |
| Pulses | 3 × 35 | 3 × 10 | 2 × 17 |
| Codebook gains | 3 × 3 + 3 × 5 | 3 × 3 + 3 × 4 | 2 × 7 |

Figure 2A:
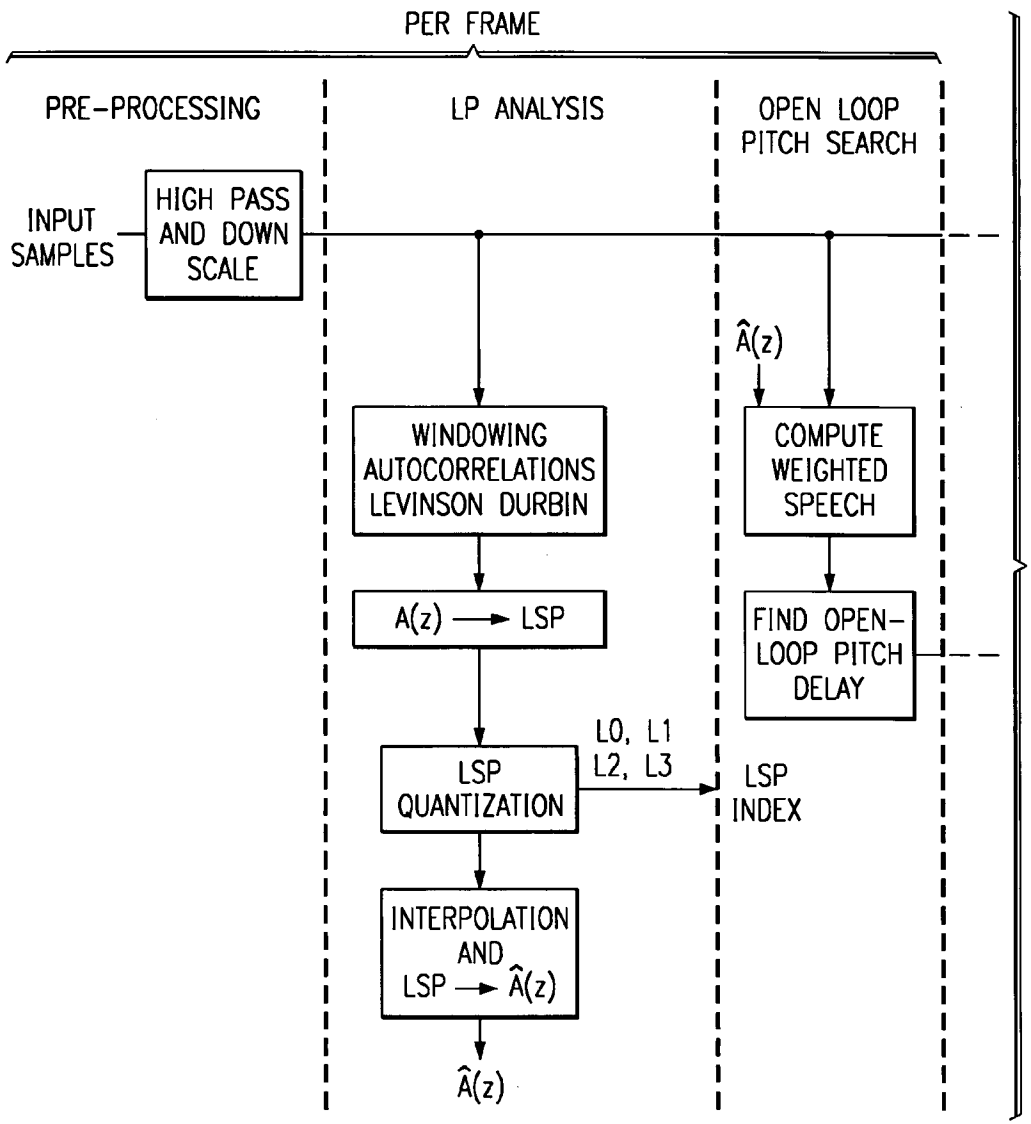
FIG. 2a (PRIOR ART)
FIGS. 2*a*-2*b* show functional blocks of G.729a encoding.
Figure 2B:
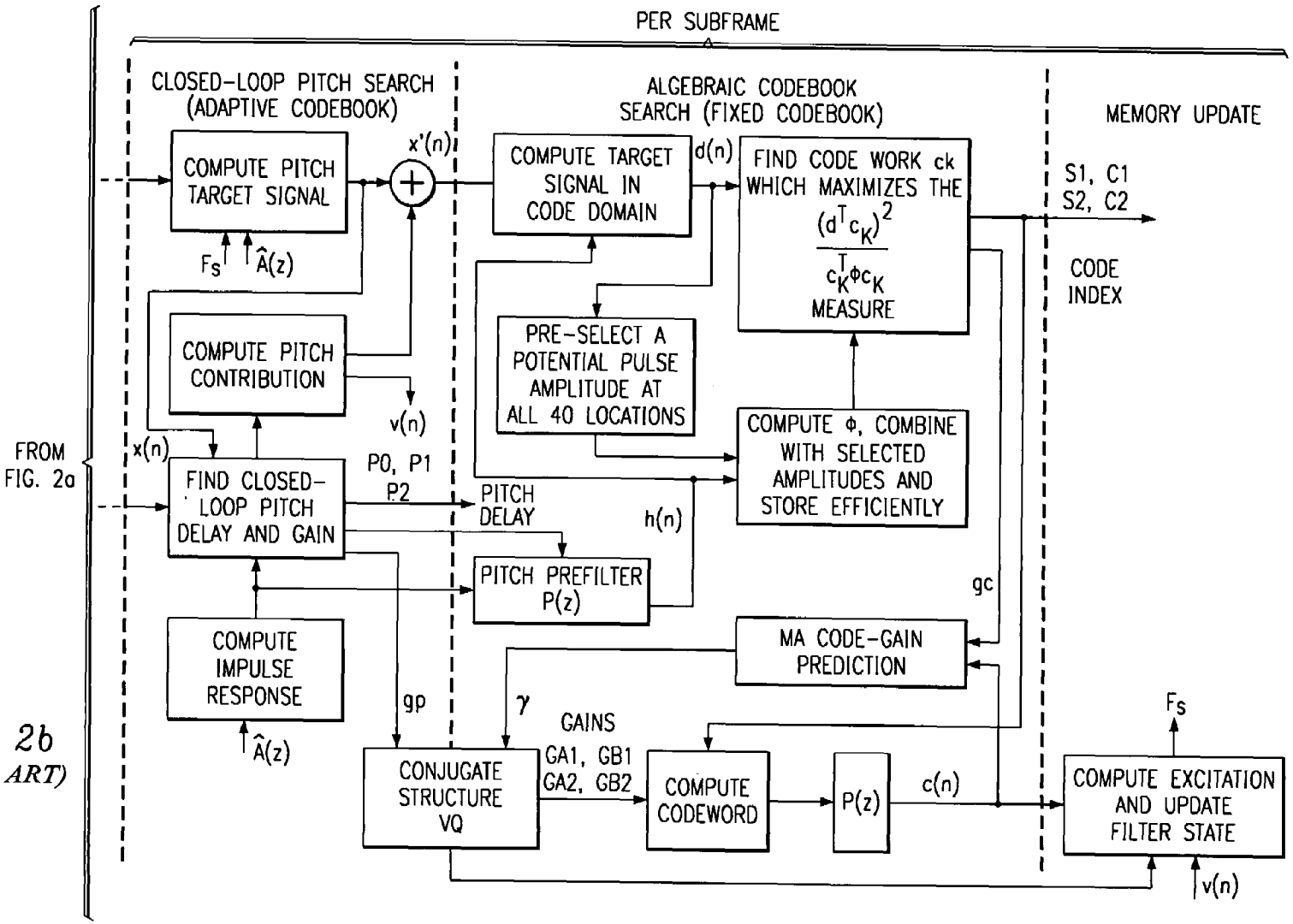
FIG. 2b (PRIOR ART)

The following sections describe the preferred embodiment methods of generating G.729ab parameters for a pair of frames from available EVRC parameters plus the frame of speech synthesized from the EVRC parameters. FIG. 3 shows the relation of frames and subframes used. The ordering of the encoding steps is the same as in the G.729a standard; FIGS. 2*a*-2*b* form a functional block diagram. Note that the fixed codebook search differs in details depending upon whether the input EVRC frame is full-rate or half-rate. With input EVRC ⅛ rate frames, the discontinuous transmission (DTX)

mode of G.729ab can be used. The DTX mode has low complexity and EVRC decoding followed by G.729ab encoding suffices.

3. LP Analysis

Both G.729ab and EVRC apply LP (linear predictive) analysis of input windowed speech to generate 10-vectors of LP coefficients defining $10^{th}$ order polynomial analysis filters A(z). The LP coefficients are converted to LSPs (line spectral pairs) for quantization efficiency, and decoding converts the quantized LSPs back to quantized LP coefficients and filters $\hat{A}(z)$.

EVRC computes one set of LP coefficients per 180-sample frame and encodes the corresponding quantized LSPs. For decoding, the LSPs are interpolated (using the LSPs of the prior frame) to have LSPs for each subframe. Denote these decoded vectors of LSPs for the three EVRC subframes as: $lsp_{EVRC}(0)$, $lsp_{EVRC}(1)$, and $lsp_{EVRC}(2)$. For each subframe, conversion back to LP coefficients gives the corresponding quantized subframe synthesis filter which will be used in reconstructing the EVRC frame of synthesized speech.

G.729ab finds one set of LP coefficients per 80-sample frame and converts to LSPs for quantization. For processing on a subframe basis, G.729ab interpolates the LSP coefficients and then converts back to LP coefficients. Thus EVRC and G.729ab have very similar LP contours, and the preferred embodiment methods apply a direct transformation of LSP coefficients from EVRC to G.729ab. In particular, for the first 80-sample G.729ab frame of a pair which coincide with a 160-sample EVRC frame, determine LSPs from the EVRC subframe LSPs by interpolation:

$$lsp_{G729}(1)=0.75\ lsp_{EVRC}(0)+0.25\ lsp_{EVRC}(1)$$

And for the second 80-sample G.729ab frame of the pair determine the LSPs as:

$$lsp_{G729}(2)=0.25\ lsp_{EVRC}(1)+0.75\ lsp_{EVRC}(2)$$

Then quantize $lsp_{G729}(1)$ with the two-stage VQ quantizer for output of the first G.729ab encoded frame, and similarly quantize $lsp_{G729}(2)$ for output of the second encoded frame.

Further, interpolate the G.729ab frame quantized LSPs to have LSPs for the 40-sample subframes, and convert these quantized LSPs to quantized LP coefficients to define analysis and synthesis filters, $\hat{A}(z)$ and $1/\hat{A}(z)$, for each of the subframes.

In other words, the preferred embodiment methods essentially replace G.729ab LP analysis on decoded EVRC synthesized speech with interpolations of the EVRC LP analysis results. Experimentally, this saved 72% of the LP analysis computations.

4. Perceptual Weighting

The perceptual weighting filter, W(z), in G.729ab derives from the quantized LP analysis and synthesis filters: $W(z)=\hat{A}(z)/\hat{A}(z/\gamma)$ with $\gamma=0.75$. Of course, these filters are computed from the LP coefficients encoded as LSPs of section 3, and are interpolated to have a filter defined for each 40-sample subframe. Note that the combination of the perceptual weighting filter and the synthesis filter, $W(z)/\hat{A}(z)$, simplifies to the single filter $1/\hat{A}(z/\gamma)$ which will be used in computation of the impulse response and the target signal in following sections 6-7. These inverse filters are infinite impulse response filters and have memories with ten entries. The updating of the filter memories appears in section 13.

5. Open-Loop Pitch Analysis

Both EVRC and G.729ab search an autocorrelation to find an initial (open-loop) pitch delay; EVRC searches the autocorrelation of the residual and G.729ab searches the autocorrelation of perceptual weighted (by W(z)) and low-pass filtered (by $1/(1-0.7z^{-1})$) speech. The open-loop pitch delay, $T_{open\text{-}loop}$, is then used in the adaptive codebook search (see section 8) to yield a closed-loop pitch delay and an adaptive codebook gain, which are quantized and encoded parameters. EVRC performs an open-loop pitch analysis once per 160-sample frame, and G.729ab performs an open-loop pitch analysis once per 80-sample frame.

However, the pitch delays for EVRC and G.729ab should be very similar because pitch delay is a physical parameter and not a characteristic of the codec. Thus the preferred embodiment methods will replace the G.729ab open-loop pitch analysis with the decoded EVRC closed-loop pitch delay. That is, first decode the EVRC quantized pitch delay, $T_{EVRC}$, for a 160-sample frame, and then interpolate (analogous to the LSPs) for the three subframes to have $T_{EVRC}(0)$, $T_{EVRC}(1)$, and $T_{EVRC}(2)$. Next, take the G.729ab open-loop pitch delay for frames 1 and 2, $T_{G729_open\text{-}loop}(\mathbf{1})$ and $T_{G729_open\text{-}loop}(\mathbf{2})$, as the (integer parts of the) interpolations:

$$T_{G729_open\text{-}loop}(1)=0.75\ T_{EVRC}(0)+0.25\ T_{EVRC}(1)$$

$$T_{G729_open\text{-}loop}(2)=0.25\ T_{EVRC}(1)+0.75\ T_{EVRC}(2)$$

The G.729ab open-loop pitch delays are interpolated to the subframes in the closed-loop search of section 8.

Without this mapping of the encoded EVRC pitch delay to the open-loop pitch delay for G.729ab, the open-loop pitch analysis would have used the filters of section 4 applied to the EVRC decoded and synthesized frame of speech. This decoding and synthesis still must be performed because the preferred embodiment methods use the EVRC speech frame in the closed-loop search. Thus the preferred embodiment methods avoid the open-loop search but not the decoding and speech synthesis; experimentally, this saved 56% of the pitch extraction computations.

6. Computation of the Impulse Response

G.729ab uses the impulse response, h(n), of the weighted synthesis filter, $1/\hat{A}(z/\gamma)$, from section 4 for convolution with the residual and the past excitation in the adaptive codebook search in sections 7-8 and, after pitch prefiltering, for the correlation and matrix of the fixed codebook in section 8. The impulse response is computed for each subframe.

7. Computation of the Target Signal for the Adaptive Search

G.729ab computes the target signal, x(n), for the closed-loop pitch (adaptive codebook) search from the residual by filtering with the combination of synthesis filter and weighting filter, $\hat{A}(z/\gamma)$, from section 4. The residual is derived from the decoded and synthesized EVRC frame. Thus proceed as follows.

(a) Decode the EVRC parameters and synthesize the 160-sample frame of speech, $s_{EVRC}(n)$.

(b) For each G.729ab 40-sample subframe, apply the subframe's analysis filter, $\hat{A}(z)$ from section 3, to the corresponding portion of $s_{EVRC}(n)$ to yield a residual, $r(n)=s_{EVRC}(n)+\Sigma_j \hat{a}_j s_{EVRC}(n-j)$, for each subframe.

(c) Apply the combined synthesis and weighting filter, $1/\hat{A}(z/\gamma)$ from section 4, to r(n) and thereby generate the target signal, $x(n)=r(n)-\Sigma_j \hat{a}_j \gamma^j x(n-j)$, where the initial ten x(n−j) terms are in the filter memory and are the tail of the target signal of the prior subframe. Note that r(n) is also used in the adaptive codebook search of section 8 to extend the past excitation buffer.

8. Adaptive-Codebook (Closed-Loop Pitch) Search

The preferred embodiment methods follow the G.729ab adaptive codebook (closed-loop pitch) search.

(a) G.729ab searches for the pitch delay, k, which minimizes the error $\|x(n)-y_k(n)\|^2$ on a subframe where the target signal x(n) is from section 7 and $y_k(n)$ is the past excitation delayed k and filtered by the combined weighting and synthesis filter $1/\hat{A}(z/\gamma)$ from section 4. Differentiation of the error and simplification lead to searching for k to maximize the correlation $R_N(k)$:

$$R_N(k) = \sum_m x(m)y_k(m) = \sum_m x(m)\sum_n h(m-n)u(n-k) = \sum_n x_b(n)\,u_k(n)$$

where $x_b(n)$ is the backward-filtered target signal (the correlation $\Sigma_m x(m)h(m-n)$), and $u_k(n)$ is the past (from prior subframes) excitation with delay k:u(n−k).

For the first subframe of a frame the search is limited to k within an interval of six samples around $T_{open\text{-}loop}$ from section 5. The pitch delay, $T_1$, in the range 19 to 84 is found to resolution ⅓ sample and in the range 85 to 143 is found to integer sample resolution. Evaluate $R_N(k)$ for fractional k by interpolation of $R_N(k)$ with a windowed sinc filter truncated at ±12.

For the second subframe the search for the pitch delay, $T_2$, is limited to an interval about $T_1$.

(b) Once the pitch delay ($T_1$ or $T_2$) has been determined in (a), the adaptive codebook vector v(n) for a subframe is computed by interpolating the past excitation signal u(n) at the integer delay k and fraction t (i.e., $T_j$=k+t/3):

$$v(n)=\Sigma_i u(n-k+i)b_{30}(t+3i)+\Sigma_i u(n-k+1+i)b_{30}(3-t+3i)$$

where $b_{30}$ is the windowed sinc filter truncated at ±30.

The pitch delay is encoded with 8 bits in the first subframe ($T_1$) and 5 bits in the second subframe ($T_2$) as an increment from $T_1$.

(c) Lastly, the adaptive codebook gain, $g_p$, is computed as $$g_p=\Sigma_n x(n)y(n)/\Sigma_n y(n)y(n)$$

where x(n) again is the target signal from section 7, and y(n) is the convolution of v(n) with h(n) from section 6:

$$y(n)=\Sigma_i v(i)h(n-i)$$

Quantize and encode $g_p$ in section 12 along with the fixed codebook gain, $g_c$.

9. Fixed Codebook Search

G.729ab finds the fixed codebook vector, c(n), for a 40-sample subframe by approximating a minimization of the subframe error $\|x(n)-g_p y(n)-z(n)\|$ where x(n), $g_p$, and y(n) are as in section 8 and z(n) is the convolution of the fixed codebook vector c(n) with the impulse response h(n):$z(n)=\Sigma_i c(i)h(n-i)$. The vector c(n) has all 0 entries except for 4 pulses with amplitudes ±1. Also, if the pitch delay from section 8 is less than 40 (so two pitch pulses appear in a single subframe), then pitch prefilter h(n) by using $h(n)+\hat{g}_p^{(m-1)}h(n-T)$ for n in the range T to 39 where T is the integer part of the pitch delay and $\hat{g}_p^{(m-1)}$ is the quantized adaptive codebook gain from the prior frame. Similarly, prefilter c(n).

Again, differentiation of the error with respect to the vector c(n) shows that if $c_j$ is the jth fixed codebook vector, then search the codebook to maximize the ratio of squared correlation to energy:

$$(x-g_p y)^t Hc_j)^2/c_j^t\Phi c_j=(d^t c_j)^2/c_j^t\Phi c_j$$

where $x-g_p y$ is the target signal vector from section 7 updated by subtracting the adaptive codebook contribution, H is the 40×40 lower triangular Toepliz convolution matrix with diagonal h(0) and lower diagonals h(1), . . . , h(39); the symmetric matrix $\Phi=H^tH$; and $d=H^t(x-g_p y)$ is a vector containing the correlation between the target vector and the impulse response (backward filtered target vector). The vector d and the needed elements of matrix Φ are computed before the codebook search.

The 40-sample subframe is partitioned into 5 interleaved tracks of 8 samples each and c(n) has 4 pulses with 1 pulse in each of tracks 0, 1, and 2 plus 1 pulse for the combination of tracks 3-4. A simplification presumes that the sign of a pulse at position n is the same as the sign of d(n) (component of d), and thus the correlation $d^t c_k=|d(m_0)|+|d(m_1)|+|d(m_2)|+|d(m_{3\text{-}4})|$, where $m_k$ is the position of the pulse on track k. Similarly, the 16 nonzero terms of $c_j^t\Phi c_j$ can be simplified by absorbing the signs of the pulses (which are determined by position from d(n)) into the Φ elements; that is, replace φ(m, n) with sign[d(m)] sign[d(n)] φ(m,n) which then makes $c_j^t\Phi c_j=\phi(m_0,m_0)+2\phi(m_0,m_1)+2\phi(m_0,m_2)+2\phi(m_0,m_{3\text{-}4})+\phi(m_1,m_1)+2\phi(m_1,m_2)+2\phi(m_1,m_{3\text{-}4})+\phi(m_2,m_2)+2\phi(m_2,m_{3\text{-}4})+\phi(m_{3\text{-}4},m_{3\text{-}4})$. Thus store the 40 possible $\phi(m_j,m_j)$ terms plus the 576 possible $2\phi(m_i,m_j)$ terms for i<j. Thus the fixed codebook search is a search for the pattern of positions of the 4 pulses which maximizes the ratio of squared correlation to energy; and there are 8096 (=8*8*8*(8+8)) possible patterns for the positions of the 4 pulses.

The G.729ab search for the pulse positions ($m_0$, $m_1$, $m_2$, $m_{3\text{-}4}$) proceeds with sequential maximization of pairs of positions; this reduces the number of patterns to search. First search for $m_2$ and $m_3$ with $m_2$ confined to the two maxima of |d(n)| on track 2 but $m_3$ any of the 8 positions on track 3; that is, maximize the partial ratio of $(|d(m_2)|+|d(m_3)|)^2$ divided by $\phi(m_2,m_2)+2\phi(m_2,m_3)+\phi(m_3,m_3)$ over the 2×8 allowed pairs ($m_2$,$m_3$). Once $m_2$ and $m_3$ are found, then find $m_0$ and $m_1$ by maximizing the ratio of $(|d(m_0)|+|d(m_1)|+|d(m_2)|+|d(m_3)|)^2$ divided by $\phi(m_0,m_0)+2\phi(m_0,m_1)+2\phi(m_0,m_2)+2\phi(m_0,m_{3\text{-}4})+\phi(m_1,m_1)+2\phi(m_1,m_2)+2\phi(m_1,m_3)+\phi(m_2,m_2)+2\phi(m_2,m_3)+\phi(m_3,m_3)$ over the 8×8 pairs ($m_0$,$m_1$) with $m_2$ and $m_3$ as already determined. Thus this search over 16+64=80 possibilities gives a first pattern of pulse positions, ($m_0$,$m_1$,$m_2$,$m_3$), which maximizes the ratio. Next, cyclically repeat this two-step search for a maximum ratio three times: first for ($m_3$,$m_0$) plus ($m_1$,$m_2$); next, for ($m_4$,$m_2$) plus ($m_0$,$m_1$); and then for ($m_4$, $m_0$) plus ($m_1$,$m_2$). Finally, pick the pattern of pulse positions ($m_0$,$m_1$,$m_2$,$m_{3\text{-}4}$) which gave the largest of the four maximum ratios. Thus a total of 320 patterns of pulse positions are searched (ratios computed); and this is only 3.9% (=320/8096) of the total number of patterns.

In contrast, the preferred embodiment methods reduce the complexity of the G.729ab fixed codebook search by limiting (presetting) the pulse positions searched to default positions plus positions found from decoding the EVRC fixed codebook vector and the maxima of the correlation vector d(n). And this limitation on pulse position patterns searched permits full searches rather than the pairwise sequential searches while still reducing the complexity. First consider the case of EVRC Full-rate.

10. Pulse Presetting with EVRC Full-Rate

EVRC has subframes with 53 or 54 samples, so a 55-sample interval is used for the fixed codebook vector. The 55 samples are partitioned into 5 interleaved tracks of 11 samples each and labeled T0, T1, T2, T3, and T4. EVRC Full-rate has a total of 8 pulses with 3 tracks each having 2 pulses the remaining 2 tracks each having only 1 pulse. The 1-pulse tracks are allowed in the following pairs: T3-T4, T4-T0, T0-T1, T1-T2. For example, when T0 and T1 are the 1-pulse tracks, then T2, T3 and T4 are the 2 pulse tracks. (In contrast, EVRC Half-rate has only 3 pulses with one pulse in each of tracks 0, 1, and 2. See following section 11.)

The preferred embodiment methods replace the foregoing G.729ab fixed codebook search with a smaller search determined by the pulse positions of the EVRC fixed codebook vector plus the correlation vector d(n). In particular, proceed as follows.

(a) First find pulse positions to search by a pre-setting of an initial guess for the most likely pulse positions. The preferred embodiment methods take the most likely pulse position candidates to be the EVRC pulse positions found by decoding the fixed codebook vector along with the maximum of |d(n)|. Thus, define 3 allowed pulse positions in each of the 5 tracks of the 40-sample G.729ab subframe by taking up to 2 allowed positions to be the positions which are also pulse positions of a corresponding EVRC fixed codebook vector for a subframe containing or overlapping the G.729ab subframe, and take a third allowed position to be the position of the maximum of |d(n)| on the track if this differs from the EVRC pulse positions. The default position is the first position in a track.

More explicitly, initially consider the first G.729ab subframe of the first frame with sample positions 0, 1, 2, . . . , 39 and EVRC subframe 0 with sample positions 0, 1, 2, . . . , 52; see FIG. 3. Thus track 0 of the G.729ab subframe (positions 0, 5, . . . , 35) is a subset of track 0 of EVRC subframe 0 (positions 0, 5, . . . 35, 40, 45, 50), and similarly for the other four tracks. Let $c_{EVERC}(n)$ denote the decoded EVRC fixed codebook vector for subframe 0. Next, define a 5×3 array pos[.][.] with each of the 5 rows corresponding to one of the 5 tracks of the G.729ab subframe and the 3 entries in row k as 3 allowed search positions on the corresponding track k. Initialize the array by setting each of the 3 entries of a row equal to the first position of the corresponding track: pos[k][0]=pos[k][1]= pos[k][2]=k for k=0, 1, . . . , 4. Next, step through the positions of track k and change pos[k][0] or pos[k][1] to a position which also is a pulse position of the EVRC codebook vector, $c_{EVRC}(n)$. Because $c_{evrc}(n)$ has at most 2 pulses per EVRC track, at most two entries will be made in each row of the array. Conversely, if one or both pulses of $c_{EVRC}$ on EVRC track k are at positions beyond the corresponding G.729ab track k (for example, positions 40, 45, 50 for track 0), there may none or only one pulse position entry made. The following pseudocode illustrates:

```
for (k = 0; k < 5; k++)                    // track k
{   m = 0;                                 // first column for row k
    for (j = 0; j < 8 &&m < 2; j++)        // step through track k
    {   if (C_EVRC(k+5*j) != 0)            // k+5j is EVRC pulse position
        {   pos[k][m] = k+5*j ;            // pulse position into column
            m++ ;                          // next column
        }
    }
}
```

For the first 40-sample subframe of the first 80-sample G.729ab frame, the subframe is completely within EVRC subframe 0 as just described. However, for the second G.729ab subframe of the first frame and the first subframe of the second frame, the tracks lie partially in two EVRC subframes and the maximum number of pulse positions on a single G.729ab subframe track increases to 4, but as illustrated in the pseudocode the method stops at two. The second subframe of the second G.729ab frame will lie within EVRC subframe 2 and the pulse position arrangement method mirrors the method for the first subframe of the first G.729ab frame.

After entering any EVRC pulse positions into the array pos[.][.], for each track k, enter the position of the maximum of |d(n)| on track k as pos[k][2] unless this position already appears as pos[k][0] or pos[k][1].

(b) Then search over the pos[.][.] array positions for the maximum of the squared correlation divided by energy. This is a search over 3*3*3*(3+3)=162 pulse position patterns for the 4 pulses; importantly, this is an exhaustive search and avoids the sequential searching of two pairs of 2 pulse positions as in G.729ab. The following pseudocode illustrates the search.

```
m0 = 0; m1 = 1; m2 = 2; m34 = 3;           // pulse positions
max = 0;                                   // the maximization
for (k0 = 0; k0 < 3; k0++)                 // track 0
{   for (k1 = 0; k1 < 3; k1++)             // track 1
    {   for (k2 = 0; k2 < 3; k2++)         // track 2
        {   for (k3 = 0; k3 < 3; k3++)     // track 3
            {   C = abs(d(pos[0][k0])) + abs(d(pos[1][k1])) +
                    abs(d(pos[2][k2])) + abs(d(pos[3][k3]))
                E = ϕ(pos[0][k0],pos[0][k0]) + ϕ(pos[1][k1],
                    pos[1][k1]) + ϕ(pos[2][k2],pos[2][k2]) + ϕ
                    (pos[3][k3],pos[3][k3]) + ϕ(pos[0][k0],
                    pos[1][k1]) + ϕ(pos[0][k0],pos[2][k2]) +
                    ϕ(pos[0][k0],pos[3][k3]) + ϕ(pos[1][k1],
                    pos[2][k2]) + ϕ(pos[1][k1],pos[3][k3]) +
                    ϕ(pos[2][k2],pos[3][k3]) +
                R = C*C/E;
                if (R > max)
                {   max = R;
                    m0 = pos[0][k0]; m1 = pos[1][k1];
                    m2 = pos[2][k2]; m34 = pos[3][k3];
                }
            for (k4 = 0; k4 < 3; k4++)     // track 4
            {   C = abs(d(pos[0][k0])) + abs(d(pos[1][k1])) +
                    abs(d(pos[2][k2])) + abs(d(pos[4][k4]))
                E = ϕ(pos[0][k0],pos[0][k0]) + ϕ(pos[1][k1],
                    pos[1][k1]) + ϕ(pos[2][k2],pos[2][k2]) +
                    ϕ(pos[4][k4],pos[4][k4]) + ϕ(pos[0][k0],
                    pos[1][k1]) + ϕ(pos[0][k0],pos[2][k2]) +
                    ϕ(pos[0][k0],pos[4][k4]) + ϕ(pos[1][k1],
                    pos[2][k2]) + ϕ(pos[1][k1],pos[4][k4]) +
                    ϕ(pos[2][k2],pos[4][k4]) +
                R = C*C/E;
                if (R > max)
                {   max = R;
                    m0 = pos[0][k0]; m1 = pos[1][k1];
                    m2 = pos[2][k2]; m34 = pos[4][k4];
                }
            }
        }
    }
}
```

Then the fixed codebook vector c(n) has pulses of sign d(n) at the four positions n=m0, m1, m2, m34. Experimentally, this limited position full searching saved 40% of the fixed codebook search computations but yielded comparable quality essentially because of the better initial guess about the pulse positions.

The codebook vector is encoded as in G.729ab with 17 bits: four sign bits and three bits for the position in tracks 0, 1, and 2 plus four bits for the position in tracks 3-4.

11. Pulse Presetting with EVRC Half-Rate

The fixed codebook search with EVRC Half-rate parameters is analogous to the fixed codebook search with EVRC Full-rate parameters as in section 10. However, with EVRC Half-rate the process is simpler because there are only three pulses per EVRC subframe. Because the structure of the codebook in EVRC half-rate is dissimilar to that of G.729ab, there is a minor change in procedure: three of the four G.729ab pulses can be on tracks with a EVFRC pulse and thus have a limited search, but the fourth G.729ab pulse will be on a track without a EVRC pulse and the method does a search of the entire track. In particular, again initially consider the first G.729ab subframe of the first frame with sample positions 0, 1, 2, . . . , 39 and EVRC subframe 0 with sample positions 0,1, 2, . . . , 52; see FIG. 3. Thus pick target pulse positions for track 0 of the G.729ab subframe (positions 0, 5, . . . , 35) from the EVRC pulse positions (and the maximum of |d(n)|). Similarly allowed pulse positions for tracks 1 and 2 are also picked. However, there are only three possible pulses from the EVRC codebook vector, so the fourth pulse position in tracks 3-4 is not limited and the tracks searched exhaustively. Let $c_{EVRC}(n)$ denote the decoded EVRC fixed codebook vector for subframe 0. Next, define a 5×8 array pos[.][.] with each of the 5 rows corresponding to one of the 5 tracks of the G.729ab subframe. As there are only 2 allowed search positions on the first 3 tracks only the first 2 columns of the array are used for these rows. As in the EVRC Full-rate case, the search positions are determined by the positions of the EVRC pulses and the position which maximizes |d(n)| in a track as follows.

Begin by initializing the 5×2 subarray by setting each of the first 2 entries of a row equal to the first position of the corresponding track: pos[k][0]=pos[k][1]=k for k=0, 1, . . . , 4. Next, step through the positions of track k and change pos[k][0] to a position which also is a pulse position of the EVRC fixed codebook vector, $c_{EVRC}(n)$. Because $c_{evrc}(n)$ has at most 1 pulse per EVRC track, at most one entry will be made in each row of the array. Further, if a pulse of $c_{EVRC}$ on EVRC track k is at a position beyond the corresponding G.729ab track k (for example, position 40, 45, or 50 for track 0), then there is no pulse position entry made. Lastly, for each k take pos[k][1] to be the position of the maximum of |d(n)| if this differs from pos[k][0]. The following pseudocode illustrates the position search assignment.

```
for (k = 0; k < 3; k++)                          // track k for k = 0,1,2
    {       max = −1;                            // max for |d(n)| on
                                                 track k
            for (j = 0; j < 8; j++)              // step through track k
            {   if (C_EVRC(k+5*j) != 0)          // if k+5j is EVRC pulse
                                                 position
                    pos[k][0] = k+5*j ;          // EVRC pulse position
                if ( abs(d(k+5*j)) > max )       // if k+5j is |d(n)| current
                                                 max
                {   max = abs(d(k+5*j));
                    if (k+5*j != pos[k][0] )
                        pos[k][1] = k+5*j ;          // |d(n)| max
                                                     position
                }
            }
    }
for (k = 3 ; k < 5 ; k++)                    // tracks 3, 4
    {
        for(j = 0; j < 8; j++)
            {
             pos[k][j]=k+5*j;
            }
}
```

As described for the EVRC Full-rate, for the first 40-sample subframe of the first 80-sample G.729ab frame, the subframe is completely within EVRC subframe 0 as just described. However, for the second G.729ab subframe of the first frame and the first subframe of the second frame, the tracks lie partially in two EVRC subframes. And because the number of samples in a EVRC subframe is not a multiple of 5, the alignment by track number with the G.729ab tracks changes, so the track labeling changes and different rows of pos[.][.] are limited to the first two columns.

(b) Then search over the array of allowed positions for the maximum of the squared correlation divided by the energy. This is a search over 2*2*2*(8+8)=128 pulse position patterns for the 4 pulses; this is a full search of these allowed pulse positions and avoids the sequential searching of two pairs of 2 pulse positions as in G.729ab. The following search pseudocode illustrates.

```
m0 = 0; m1 = 1; m2 = 2; m34 = 3;            // pulse positions initialization
max = 0;                                    // the maximization
for (k0 = 0; k0 < 2; k0++)                  // track 0 allowed 2 positions
{   for (k1 = 0; k1 < 2; k1++)              // track 1 allowed 2 positions
    {   for (k2 = 0; k2 < 2; k2++)          // track 2 allowed 2 positions
        {   for (k3 = 0; k3 < 8; k3++)      // track 3 all positions
            {   C = abs(d(pos[0][k0])) + abs(d(pos[1][k1])) +
                    abs(d(pos[2][k2])) + abs(d(pos[3][k3]))
                E = ϕ(pos[0][k0],pos[0][k0]) + ϕ(pos[1][k1],
                    pos[1][k1]) + ϕ(pos[2][k2],pos[2][k2]) +
                    ϕ(pos[3][k3],pos[3][k3]) + ϕ(pos[0][k0],
                    pos[1][k1]) + ϕ(pos[0][k0],pos[2][k2]) +
                    ϕ(pos[0][k0],pos[3][k3]) + ϕ(pos[1][k1],
                    pos[2][k2]) + ϕ(pos[1][k1],pos[3][k3]) +
                    ϕ(pos[2][k2],pos[3][k3]) +
                R = C*C/E;
                if (R > max)
                {   max = R;
                    m0 = pos[0][k0]; m1 = pos[1][k1];
                    m2 = pos[2][k2]; m34 = pos[3][k3];
                }
            for (k4 = 0; k4 < 8; k4++)      // track 4 all positions
            {   C = abs(d(pos[0][k0])) + abs(d(pos[1][k1])) +
                    abs(d(pos[2][k2])) + abs(d(pos[4][k4]))
                E = ϕ(pos[0][k0],pos[0][k0]) + ϕ(pos[1][k1],
                    pos[1][k1]) + ϕ(pos[2][k2],pos[2][k2]) +
                    ϕ(pos[4][k4],pos[4][k4]) + ϕ(pos[0][k0],
                    pos[1][k1]) + ϕ(pos[0][k0],pos[2][k2]) +
                    ϕ(pos[0][k0],pos[4][k4]) + ϕ(pos[1][k1],
                    pos[2][k2]) + ϕ(pos[1][k1],pos[4][k4]) +
                    ϕ(pos[2][k2],pos[4][k4]) +
                R = C*C/E;
                if (R > max)
                {   max = R;
                    m0 = pos[0][k0]; m1 = pos[1][k1];
                    m2 = pos[2][k2]; m34 = pos[4][k4];
                }
            }
        }
    }
}
```

Then the fixed codebook vector c(n) has pulses of sign d(n) at the four positions n=m0, m1, m2, m34.

Again, the codebook vector is encoded as in G.729ab with 17 bits: four sign bits and three bits for the position in tracks 0, 1, and 2 plus four bits for the position in tracks 3-4.

12. Quantization of the Gains

The preferred embodiment methods follow G.729ab and determine the fixed codebook gain $g_c$ and jointly vector quantize the two codebook gains $g_p$ and $g_c$ by minimizing the error $\|x(n)-g_p y(n)-g_c z(n)\|$ where z(n) is the convolution of the impulse response h(n) from section 7 with the fixed codebook vector c(n) from the fixed codebook search of section 10 or 11. The quantization uses a predictor from the prior frame for the fixed codebook gain, $g_c$.

13. Memory Update

An update of the synthesis and weighting filters (both infinite impulse response filters) is needed to compute the target signal in the next subframe. The preferred embodiment methods follow G.729ab and first compute the excitation using the quantized gains, the the adaptive-codebook vector (interpolated past excitations), and the fixed-codebook vector including harmonic enhancement by pitch pre-filtering. Then filter the difference of the excitation and the residual to update the filter state.

14. Modifications

The preferred embodiments can be modified in various ways while maintaining the feature of transcoding for ACELP codecs with a presetting of pulse positions for searching from input pulse positions and correlation maxima.

For example, a similar methodology can be employed for transcoding of EVRC from G.729ab. This method can be in fact applied for transcoding between most pairs of ACELP codecs. This method gives very good initial candidates for the ACELP fixed codebook search, which, in effect, reduces complexity significantly. Further variations include (i) letting all 3 allowed search positions on a G.729 track be pulse positions from the EVRC full-rate tracks when the G.729 track overlaps two EVRC tracks; (ii) only computing the energy matrix elements after the allowed search positions are determined because there are so few search positions; and so forth.

What is claimed is:

1. A method of transcoding, comprising:

(a) decoding input first frames, said first frames encoded with a first ACELP method;

(b) finding linear prediction coefficients and pitch delays for second frames of a second ACELP method using said first frames;

(c) finding fixed codebook vectors for said second frames by searching over allowed pulse positions, wherein (i) said allowed pulse positions are less than all pulse positions in said second frames, (ii) on each track of one of said second frames said allowed pulse positions include pulse positions of first ACELP fixed codebook vectors for said first frames, and (iii) on each track of one of said second frames said allowed pulse positions include the position of the maximum magnitude of a correlation vector on said each track; and (d) encoding said linear prediction coefficients, pitch delays, and fixed codebook vectors with said second ACELP method;

wherein said first ACELP method is EVRC and said second ACELP method is G.729ab.

2. The method of claim 1, wherein:

each of said second frames has 40 samples partitioned into 5 tracks of 8 samples; and each of said tracks has at most 3 allowed pulse positions.

3. The method of claim 1, wherein:

each of said second frames has 40 samples partitioned into 5 tracks of 8 samples; and each of said 5 tracks has at most 2 allowed pulse positions when a first ACELP codebook vector pulse is on said each track.

4. The method of claim 1, wherein:

the finding linear prediction coefficients of step (b) of claim 1 includes interpolation of line spectral pairs of said first frames.

5. The method of claim 1, wherein:

the finding pitch delays of step (b) of claim 1 includes using pitch delays of said first frames as inputs for closed-loop pitch searches.

* * * * *